US009724548B2

(12) United States Patent
Lechtman et al.

(10) Patent No.: US 9,724,548 B2
(45) Date of Patent: Aug. 8, 2017

(54) TERMINATING EXPANSION OF UNDERGROUND COAL FIRES AND PROTECTING THE ENVIRONMENT

(71) Applicant: Engineering Projects Management International Ltd, Sasolburg (ZA)

(72) Inventors: David Lechtman, Sasolburg (ZA); David Johnson, Edenvale (ZA)

(73) Assignee: Engineering Projects Management International Ltd, Sasolburg, Free State (ZA)

( * ) Notice: Subject to any disclaimer, the term of this patent is extended or adjusted under 35 U.S.C. 154(b) by 0 days.

(21) Appl. No.: 14/805,467

(22) Filed: Jul. 22, 2015

(65) Prior Publication Data

US 2017/0021207 A1 Jan. 26, 2017

(51) Int. Cl.

| | |
|---|---|
| ***A62C 2/04*** | (2006.01) |
| ***A62C 3/02*** | (2006.01) |
| ***A62C 3/06*** | (2006.01) |
| ***A62C 99/00*** | (2010.01) |
| ***E21F 5/00*** | (2006.01) |

(52) U.S. Cl.

CPC ..... *A62C 2/04* (2013.01); *A62C 3/0278* (2013.01); *A62C 3/06* (2013.01); *A62C 99/0063* (2013.01); *E21F 5/00* (2013.01)

(58) Field of Classification Search

CPC .. A62C 2/04; A62C 2/06; A62C 2/065; A62C 3/06; A62C 99/0018; A62C 99/0054; A62C 99/009; A62C 3/02; A62C 3/0278; E21F 5/00; E21B 43/243; E21B 43/295

See application file for complete search history.

(56) References Cited

U.S. PATENT DOCUMENTS

| | | | | | |
|---|---|---|---|---|---|
| 3,421,587 | A * | 1/1969 | Jones | E21F 17/103 | 169/15 |
| 3,927,719 | A * | 12/1975 | Maser | E21B 33/05 | 166/292 |
| 4,092,052 | A * | 5/1978 | Terry | E21B 43/295 | 166/261 |
| 4,387,655 | A * | 6/1983 | Chaiken | E21B 43/295 | 110/102 |
| 4,437,520 | A * | 3/1984 | Stoddard | E21B 33/138 | 166/261 |

(Continued)

*Primary Examiner* — Darren W Gorman

(74) *Attorney, Agent, or Firm* — Spruce Law Group, LLC

(57) ABSTRACT

Method and apparatus for environment protection (climate change) from toxic elements and subsidence by existing underground coal seam fires by expansion termination of these fires. The method is based on creating, on the path of or around a burning coal seam fire, a subterranean void-barrier, with non-combustible gases (or fluids) and absence of oxidiser. The void-barrier may be substantially free from combustible material. The void-barrier will prevent further expansion of the existing coal seam fire, and may be created by known methods of coal extraction in gasified form, such as Underground Coal Gasification (USG). By-products from void-barrier creation can be utilized to reduce environmental pollution and for production of useful commercial entities such as gas or liquid fuels like: petrol, diesel, jet fuel, avgas, paraffin or electrical power generation and/or chemicals like $CO_2$ for enrichment of coal or which may be sold.

15 Claims, 3 Drawing Sheets

(56) References Cited

U.S. PATENT DOCUMENTS

| | | | | |
|---|---|---|---|---|
| 4,641,711 | A * | 2/1987 | Terry | A62C 3/02 166/288 |
| 5,909,777 | A | 6/1999 | Jamison | |
| 7,464,992 | B1 | 12/2008 | Ozment | |
| 8,096,622 | B2 * | 1/2012 | Hussey | A62C 3/00 299/12 |
| 8,397,829 | B2 | 3/2013 | Brown | |
| 2010/0218507 | A1 | 9/2010 | Cherson | |
| 2012/0018151 | A1 * | 1/2012 | Ide | E21B 43/166 166/251.1 |

* cited by examiner expansion of coal seam fire terminated by void-barrier terminating expansion of a coal seam fire

TERMINATING EXPANSION OF UNDERGROUND COAL FIRES AND PROTECTING THE ENVIRONMENT

TECHNICAL FIELD

This disclosure relates to the field of subterranean (underground) coal seam fires and, more particularly, with terminating expansion (propagation, spreading) of the fires, and consequently protecting the environment and climate change from toxic gases and heavy metals generated by the fires, as well as soil subsidence.

BACKGROUND OF THE INVENTION

A coal seam fire or mine fire is the underground smouldering of a coal deposit, often in a coal mine. Such fires have economic, social and ecological impacts. They are often started by lightning, grass, or forest fires, and are particularly insidious because they continue to smoulder underground after surface fires have been extinguished, sometimes for many years, before flaring up and restarting forest and brush fires nearby. They propagate in a creeping fashion along mine shafts and cracks in geologic structures. Because they burn underground, coal seam fires are extremely difficult and costly to extinguish.

There are many subterranean coal seam fires around the world: in USA, Australia, South Africa, China, India and other counties. Some of these fires are burning for more than 50 years and may continue burning yet hundreds of years. The temperatures can exceed 1000° C. Enormous quantities of toxic gases and heavy metals may be thrust up to atmosphere, resulting in damaging the environment.

In order to thrive, a fire requires fuel, oxygen, and ignition or heat. As underground fires are very difficult to reach directly, firefighting involves finding an appropriate methodology which addresses the interaction of fuel and oxygen for the specific fire in question. In Pennsylvania, GAI estimated it would cost upward of $600 million to completely dig out the fire. Energy can be removed by cooling, usually by injecting large amounts of water. However, if any remaining dry coal absorbs water, the resulting heat of absorption can lead to re-ignition of a once-quenched fire as the area dries. Accordingly, more energy must be removed than the fire generates. In practice these methods are combined, and each case depends on the resources available. This is especially true for water, for example in arid regions, and for covering material, such as loss or clay, to prevent contact with the atmosphere.

This disclosure relates to the field of environment protection from toxic gases and heavy metals generated by existing subterranean coal seam fires and by-products utilisation.

Coal seam fires may cause strong environmental pollution, social and economic disaster in the areas of fire, land subsidence and enormous cost. In some cases, firefighting methods may be employed in an attempt to quench the fire. However, conventional firefighting techniques may not be effective for extinguishing the fire. In other cases, the fire may simply be abandoned. This, of course, is not a solution to the problem.

Some Related Patents/Publications

The following patents and publications may have some relevance to the techniques disclosed herein, and are incorporated by reference herein.

U.S. Pat. No. 7,464,992 (2008 Dec. 16; Ozment) discloses a method for forming a barrier by forming a barrier to seal off a remote chamber that is involved in a fire and which permits access to the area involved in a fire for additional remote firefighting operations. A conduit is then introduced through the borehole. Next, through the conduit, a flowable barrier material is introduced to the area to be sealed. More particularly, Ozment discloses > a method for forming a barrier to seal off a remote chamber including the steps of: forming a borehole that communicates between a first location and the remote chamber; inserting a conduit through the borehole to extend into the remote chamber; introducing a flowable material through the conduit to the remote chamber and dispensing the flowable material from the conduit to the desired location for the barrier, the flowable material upon being dispensed producing a substantially solid, self-sustaining composition; maintaining dispensing the flowable material to produce a sufficient quantity of the self-sustaining composition to form the barrier to seal the remote chamber, while ensuring that the composition does not block the borehole from communicating between the first location and the remote chamber; and thereafter removing the conduit to allow access to the borehole. (Abstract)

Generally described, the method provides a borehole that opens into the remote chamber and proximate the point at which a seal is to be formed. A conduit is then introduced through the borehole. Next, through the conduit, a flowable barrier material is introduced proximate the area to be sealed. After the barrier is formed, the conduit can be removed, so the borehole remains open for access to the fire involved area. (Summary)

More specifically described, the conduit is a pipe or hose and has an elbow to direct the flow of the flowable material. The flowable material has a first component and a second component. The components are mixed with each other just prior to dispensing from the conduit to the point at which the seal is to be formed. The first component may be a urethane, phenolic, or epoxy and the second component is an activator to react with the first component to produce a foam that expands and forms a barrier that is a substantially solid, self-sustaining composition. (Summary)

Ozment's technique can be used in a confined are to seal off a remote chamber by forming a barrier from foam. This will be not practical to stop underground fire expansion of coal seam. Ozment's method will not generate capital (revenue) during creation of barrier.

U.S. Pat. No. 5,909,777 (1999 Jun. 8; Jamison) discloses method and apparatus for stopping the spread of a fire in an underground mine. More particularly, Jamison discloses > An assembled length of water pipe sections having a nozzle pipe section at an inby (inlet) end is moved from a crosscut of a mine into a mine entry to stop the advance of a fire in the entry without requiring firefighters to be positioned in the fire entry. The nozzle pipe section is moved across the entry to a position adjacent to an opposite entry sidewall. The nozzle pipe section is connected at an outby (outlet) end in the crosscut by assembled sections of extension water pipes to a water feedline. Water under pressure is supplied through the extension pipes to the nozzle pipe section and discharged from the nozzles to generate a series of intersecting sprays directed at selected angles in a range between about 0-90.degrees in the entry, forming a water curtain the complete height and width of the entry. Deflected water sprays from the sidewalls and mine roof combine with the upward water sprays to form a curtain of water extending across the path of the advancing fire and into contact with roof bolts supporting the mine roof above the entry. The water spray prevents the roof bolts from being heated to an elevated temperature which can cause a loss of anchorage of the bolts in the mine roof. The water curtain also cools the hot gases generated by the fire to stop advance of the fire beyond the curtain so that the fire can be contained and extinguished. (ABSTRACT)

Using water to quench a seam fire, hydrogen may be generated at high temperatures, thereby adding fuel to the fire. Jamison's method can work inside mine on small areas at low temperatures, but if some coal will remain dry, then the coal will start burning again. Installation of such piping system toterminate underground seam fire may not be practical.

U.S. Pat. No. 8,397,829 (2013 Mar. 19; Brown) discloses a method and apparatus for controlling and extinguishing subterranean coal fires. Suitable detection and measuring devices are initially used to determine the extent of the fire and develop a plan of extinguishment. Flow control devices are added to all the mine's access points in order to control gas flow into and/or out of the mine. In addition, new access points may be added. Gaseous carbon dioxide is pumped into the mine until a positive pressure is developed (with respect to atmospheric pressure. Pressurized and liquefied carbon dioxide is directed into the area of the combustion face. The liquid carbon dioxide blankets the combustion area with a gas which will not support combustion and absorbs a tremendous amount of heat from the burning coal.

If gas will not be able to intrude in to some isolated voids in the coal—and in a coal seam there may be numerous such voids—then the fire will start again.

Some other patents of interest may include,

US 20100218507(2010 Sep. 2; Cherson) which discloses an apparatus and method for capturing, separating, transforming, and sequestering carbon wherein said apparatus dissociates a carbon containing feedstock material and reacts the resulting gases with a system-produced brine to create four products: 1) a sodium based carbonate or bicarbonate, 2) ammonium chloride, 3) fresh water, and 4) a multi-purpose building material. End product (1) may be sequestered in any of several ways for durable and long term storage. End product (2) may be used for nutrient enrichment. End products (3) and (4) may be distributed to human populations.

EP 1853358 (2013 Aug. 5; Schaefer) which discloses fire fighting foam concentrate, an expanded foam composition and a process of forming a foam composition concentrate, aqueous foaming compositions containing carbonised or caramelised saccharides. The foaming compositions are most preferably biodegradable and/or environmentally compatible.

Some shortcomings of existing techniques for combating coal seam fires may include:

Sealing the chamber by forming a barrier from "flowable" material means that only space which is empty will be filled. If flammable materials, such as coal, remain in the walls or ceiling of the space (chamber), the probability of new fire occurring is very high.

Providing a conduit (or borehole) for introducing "flowable" material is an imperfect solution in that the borehole will remain opened to air after completion of the firefighting operation, in which case new fire ignition of the coal seam may be highly possible. This method may be used only as a temporary solution.

Sealing the chamber with solid materials may render the mine difficult to re-open.

Ideally, a technique for terminating a coal seam fire, or the spread (extension) thereof would permit access to the coal seam and would allow resuming mining operations once the fire has been appropriately dealt with.

Underground Coal Gasification

Underground coal gasification (UCG) is an industrial process which converts coal into commercialproduct—Syngas. UCG is an in-situ gasification process carried out in non-mined coal seams using injection of oxidants, and bringing the product gas to surface through production wells drilled from the surface.

The predominant product gases are methane, hydrogen, carbon monoxide and carbon dioxide. Ratios vary depending upon formation pressure, depth of coal and oxidant balance. Gas output may be combusted for electricity production. Alternatively, gas can be used to produce synthetic natural gas. Hydrogen and carbon monoxide can be used as a chemical feedstock for the production of fuels (e.g. diesel), fertilizer, explosives and other products. Carbon Dioxide may be pumped into a coal seam for sequestration and increasing coals calorific value. UCG offers an alternative to conventional coal mining methods for some resources.

SUMMARY

An object of the invention disclosed herein is to reduce air pollution and prevent subsidence by terminating expansion (spreading, propagation) of subterranean coal seam fires. Other objects may include the production of useful by-products.

A by-product of the techniques disclosed herein may include syngas, for production of fuels, energy or chemicals, and these may be recovered and marketed (sold). (Syngas, or synthesis gas, is a fuel gas mixture consisting primarily of hydrogen, carbon monoxide, and very often some carbon dioxide. The name comes from its use as intermediates in creating synthetic natural gas (SNG) and for producing ammonia or methanol.) To reduce pollution, carbon dioxide may be sequestrated in healthy coal. Another by-product of the techniques disclosed herein may include land rehabilitation.

According to the invention, generally, one or more void-barrier(s)—space(s) or areas or volumes without flammable material or oxygen—may be created in the coal seam (or in the coal field) adjacent to, such as on the path of, including ahead of, or around the fire (burning coal). A coal seam fire requires oxygen to sustain burning and propagate. By creating void-barriers surrounding the area of the fire, and denying oxygen to the fire, the extension/expansion of the fire may be terminated. Void creating fire is controlled by controlling quantity of O2 and cooling by steam.

Behind the fire, only ash and emptiness will remain. The surface created by UCG may be covered with non-combustible filler, and binder (if required). Also, to prevent subsidence, some coal pillars may be left behind, or pillars may be created to support overburden. The land thus reclaimed may be an additional valuable asset.

An aspect of some embodiments of the present invention may be to utilize underground coal gasification (UCG) techniques to create the void-barrier, then subsequently (on completion of void-barrier creation) sealing off the void-barrier, or parts of the void-barrier. By-products of void creation resulting from performing UCG may be collected, sold, and used for production of useful commercial products such as gas or liquid fuels, electrical power or chemicals.

An aspect of some embodiments of the present invention may relate to termination of subterranean coal seam fire by creating underground void-barrier(s), oxygen-free, on the fire path and cost recovering in the process of fire termination.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Figure 1:
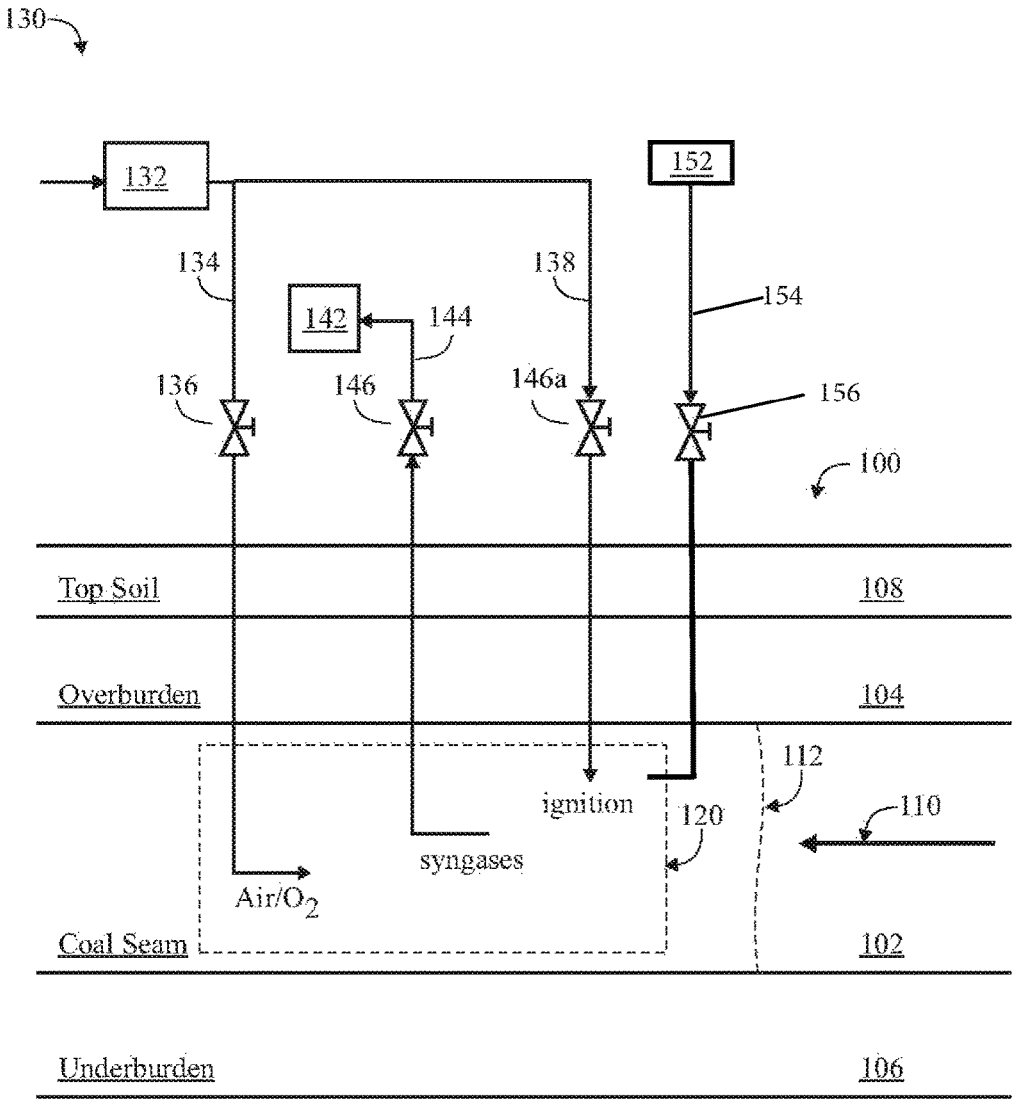
FIG. 1 is a schematic presentation of underground void-barrier creation in coal seam method, example.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE INVENTION

The present invention may be described herein in terms of exemplary environments. Description in terms of these environments is provided to allow the various features and embodiments of the invention to be portrayed in the context of an exemplary application. After reading this description, it may become apparent to one of ordinary skill in the art how the invention can be implemented in different and alternative environments.

Unless defined otherwise, all technical and scientific terms used herein have the same meaning as is commonly understood by one of ordinary skill in the art to which this invention pertains. All patents, applications, published applications and other publications referred to herein are incorporated by reference in their entirety. If a definition set forth herein is contrary to or otherwise inconsistent with a definition set forth in applications, published applications and other publications that are herein incorporated by reference, the definition set forth in this document prevails over the definition that is incorporated herein by reference.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

Coal burns. A coal seam fire, as the name infers, propagates along a subterranean coal seam which follows a path between an overlying layer of material referred to as "overburden" and an underlying layer of material referred to as "underburden". A related term is "interburden", meaning material that lies between two areas of economic interest, such as the material separating coal seams within strata. The overburden and underburden limit the vertical extent (thickness) of the coal seam. The coal seam may also have a limited lateral (horizontal) extent. The subterranean coal seam is thus bounded by other, presumably non-flammable material.

The present invention relates to methods and apparatus for terminating expansion of existing underground coal fires, and for protecting the environment from pollution by toxic gases, heavy metals and dust particles resulting from expansion of such fires. The method is based on the creation, on the path of burning coal seam fire expansion, a subterranean void-barrier, with non-combustible materials and without oxidiser (such as oxygen) to prevent further expansion of existing seam fire. In other words, the method is based on the creation of a void, which may be referred to as a "void barrier" in coal seam, ahead of the fire, by removing a volume of coal required to prevent ignition of coal remaining in seam coal by the existing fire or by spontaneous ignition from high temperatures created by the existing fire.

To ensure controlled coal removal to form the void-barrier, the removal may be performed by well-known underground coal gasification (UCG) processes. UCG involves creating entrances (accesses) to the coal seam, which are essentially wells extending from ground level, through any topsoil and overburden, into the coal seam. These entrances may include access holes for providing air/oxygen and temperature control agent (such as steam) to the coal seam, an access hole for extracting syngas from the coal seam, and another access hole for initiating ignition of coal in the seam or via extracting access.

Upon completion of coal removal from the seam, all entrances (accesses) to the void will be hermetically sealed by means (such as a valve) or materials suitable for existing on site conditions. Before sealing the accesses, a non-flammable material, or a gas such as nitrogen which will not support combustion may be introduced into the void-barrier to ensure that there is no oxidiser in the void-barrier and to prevent the coal fire from propagating past the void-barrier. In this manner, when the coal fire reaches the void barrier, it will be denied of oxygen and will extinguish itself. Subsequently, access to the coal seam for resuming mining operations may be re-established.

Syngas generated during void-barrier creation can be collected and sold, and may be (i) used for the production of liquid fuels, such as petrol, diesel, jet fuel, avgas and paraffin (ii) used for electrical power generation, and (iii) used ($CO_2$, for example) for enrichment of healthy coal or sold.

FIG. 1 is a schematic presentation, illustration, or diagram (in cross-sectional view) of an exemplary subterranean coal field 100. The coal field may comprise a coal seam 102 extending generally horizontally beneath overburden material 104 and above underburden material 106. Topsoil 108 may cover the overburden material.

A coal seam fire (not shown) is to the right of the figure (as viewed). A direction of a subterranean coal seam fire extension (or propagation of the fire) is indicated by the arrow 110, extending from right-to-left in the figure. The progress (or front) of the coal seam fire is indicated by the dashed line 112.

In order to terminate further propagation of the coal seam fire, an underground void-barrier 120 may be created, ahead of or around (to the left of, as viewed) the fire. As discussed in greater detail hereinbelow, the void-barrier may be devoid of oxidiser (such as oxygen), so that the environment in the void-barrier will not sustain further propagation of the coal seam fire. The void-barrier may also be substantially devoid of coal, the primary flammable material involved in the fire. An exemplary technique for creating the void-barrier will now be discussed.

An underground coal gasification (UCG) system 130 may be used to create the void-barrier 120, as follows.

Air or oxygen ($O_2$) may be provided by a pump 132 through a line 134 which extends into a subterranean area for creating the void-barrier, such as in the coal seam ahead of or adjacent to (or around) the fire. (For purposes of this discussion, the area for creating the void and the resulting void-barrier which is created may both be represented by the dashed line 120.) A control and/or non-return valve 136 may be disposed in the line 134, such as above-ground, for regulating (including shutting off) the flow of air or oxygen mixture and preventing back flow in case of air or oxygen pressure will drop below pressure existing in the void. A line 138 having a control/non-return valve **146*a*** may extend downward for the purpose of ignition.

When underground coal gasification (UCG) is performed, a by-product is syngas. The syngas may be collected in a collection (holding) tank 142 via a line 144 extending from the subterranean area for the void-barrier to above-ground. A control or non-return valve 146 may be disposed in the line 144, such as above-ground, for regulating (including shutting off) the flow of syngas. Ignition may be combined with Syngas outlet because syngas production will start at outlet pipe. An ignition source (not shown) may be provided. A subterranean portion of the line 144 may be considered to be an "ignition well".

"Steam may be provided by a source 152 (such as a boiler or water pump, or gravity feed) through a line **152*a* which extends into the subterranean area for creating the void-barrier. A control and/or non-return valve 156 may be disposed in the line 152*a***, such as above-ground, for regulating (including shutting off) the flow of steam and preventing back flow in the case of steam pressure dropping below the pressure in the void. "

In summary, a coal seam fire may be terminated by creating a void-barrier ahead of or around a coal seam fire. The void-barrier may be created by gasification (controlled burning) of coal in the coal seam. Gasification may be controlled by regulating the amount of oxygen available to the fire and temperature. The gasification process may be cooled with steam.

Figure 2:
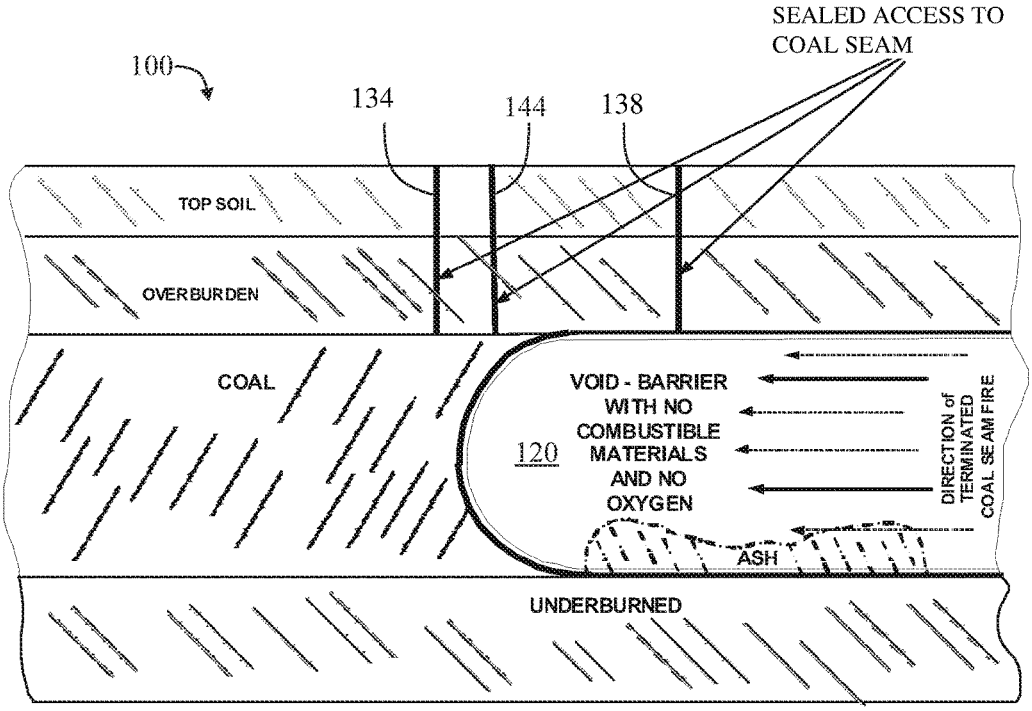
FIG. 2 is a schematic presentation of an underground void-barrier created in coal seam, and terminating expansion of a subterranean coal seam fire.

FIG. 2 is a schematic presentation, illustration, or diagram (in cross-sectional view) of the exemplary coal mine (or coal field) 100, after the void-barrier has been created. This figure illustrates that, after underground coal gasification (UCG) is performed, holes through the topsoil for the lines 134, 138 and 144 may be plugged, such as hermetically sealed. In this manner, a void-barrier 120 with no combustible materials and without oxygen has been created (formed) so that extension/expansion/propagation of the coal fire may be terminated. Ash remaining from the underground coal gasification (UCG) process may be disposed (deposited) on the bottom of the void-barrier. This ash may be used for sealing of underground surfaces and entrances (accesses) to the void-barrier.

The structural design of the void-barrier may be determined on a case-by-case basis, depending on the characteristics of the coal seam, as may be determined by various surveys and investigations.

Figure 3:
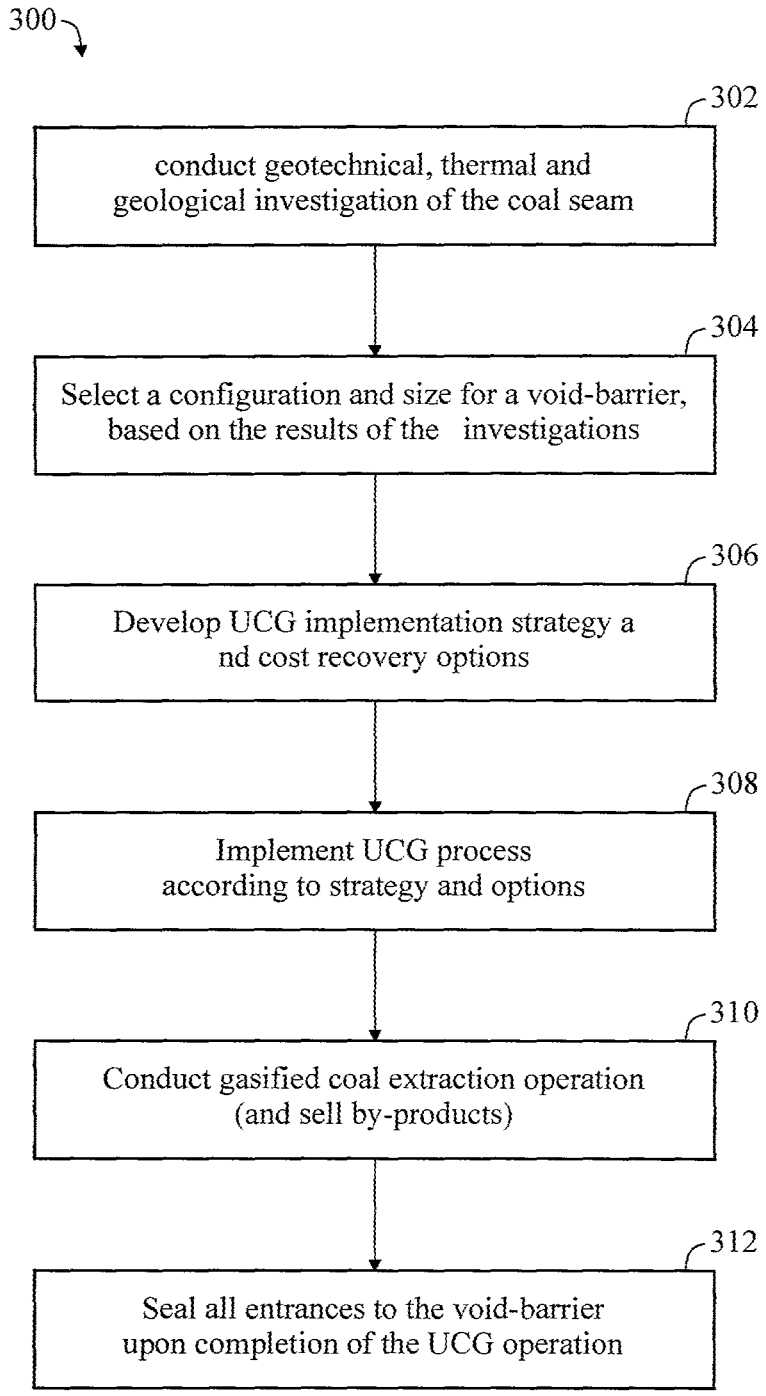
FIG. 3 is a diagram illustrating some steps of an exemplary method of terminating expansion of a subterranean coal seam fire.

FIG. 3 shows an exemplary method 300 of terminating expansion of a subterranean coal seam fire. The following steps may be performed to implement the method.

(step 302) Conduct geotechnical, thermal and geological investigation of the coal seam.

(step 304) Select a configuration and size for a void-barrier, based on the results of the investigations.

(step 306) Develop UCG implementation strategy and cost recovery options.

(step 308) Implement UCG process according to strategy and options. This involves creating accesses (entrances) to the coal seam, ahead of the fire, in an area that will become a void-barrier.

(step 310) Conduct gasified coal extraction operation (and sell by-products).

(step 312) Seal all entrances (accesses) to the void-barrier upon completion of the UCG operation.

In the process of creating the void-barrier, an overburden support structure may be formed, such as by leaving some of the coal behind, to prevent subsidence.

Optionally, the void-barrier or portions thereof may be filled, via the entrances, with non-combustible filler as well as binder, and inert gas if required, the object being to deprive the void of oxidizer and prevent exit of combustible gases generated by coal to the void so that the fire will extinguish itself upon reaching the void-barrier. (Binder is a substance (like glue) holding filler (like ash) and surface together.) Filling may be performed during creation of the void-barrier, or after completing creation of the void-barrier. After the void barrier is created and filled, the entrances to the void-barrier may be sealed to prevent oxidizer from getting into the void-barrier.

There have thus been shown some techniques for terminating expansion of underground coal by creating in the coal seam a void-barrier substantially without fuel (coal) and without oxidiser on the path of the burning fire, thereby separating (isolating) remaining coal in the seam from the fire and preventing its ignition. In this manner, substantially all of the fuel (coal) may be removed from the area/volume of the void-barrier(s).

If desired, access may then be gained to the mine, including the void-barrier, to ensure that all vestiges of the fire are appropriately dealt with, and give the "all clear" for resuming mining operations.

There has thus been described a cost-effective, safe way of fighting subterranean coal seam fires by terminating expansion of the fire.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. A method of terminating expansion of a coal seam fire by creating a void-barrier, the method comprising:

identifying a location of a coal seam fire expanding along a direction of a coal seam;

selecting a location for a potential void-barrier that is separate from the location of the coal seam fire but along the direction of the coal seam fire, wherein the location for the potential void-barrier is chosen to prevent combustion of coal remaining in the coal seam by the existing coal seam fire;

drilling holes into the location for the potential void-barrier;

connecting a line through one of the holes to deliver air or oxygen to the location of the potential void-barrier;

gasifying underground coal using underground coal gasification (UCG) in the location for the potential void-barrier, wherein the gasification comprises adding the air or oxygen to the location of the potential void-barrier through the line and igniting the coal in the location of the potential void-barrier to combust the coal and gasify the coal, thus creating the void-barrier; and sealing the location of the void-barrier.

2. The method of claim 1, wherein the selecting is done based on a path of the coal seam fire.

3. The method of claim 1, wherein the gasification removes coal from the location for the potential void-barrier to create the void-barrier.

4. The method of claim 1, wherein the sealing of the void-barrier prevents further combustion in the void-barrier.

5. The method of claim 1, further comprising adding noncombustible gas to the void-barrier.

6. The method of claim 5, wherein the noncombustible gas comprises an inert gas.

7. The method of claim 1, further comprising collecting and using syngas generated from the gasification.

8. The method of claim 1, further comprising adding steam to the location of the void-barrier to cool the location of the void barrier.

9. The method of claim 1, further comprising creating overburden support structures inside the void-barrier to prevent subsidence.

10. The method of claim 1, wherein the sealing step includes using a non-combustible filler to seal access to the location of the void-barrier.

11. The method of claim 1, further comprising: covering selected surfaces within the void-barrier with non-combustible material.

12. The method of claim 1, further comprising: preventing subsidence by leaving coal pillars behind to support overburden.

13. The method of claim 1, further comprising: ensuring that there is no oxidizer in the void-barrier before sealing accesses to the void-barrier.

14. The method of claim 1, further comprising using by-products from the void-barrier creation.

15. The method of claim 14, wherein the by-products comprise syngas and rehabilitated land.

* * * * *